US006769370B1

(12) United States Patent
Lee et al.

(10) Patent No.: US 6,769,370 B1
(45) Date of Patent: Aug. 3, 2004

(54) INCINERATOR WITH A BOWL-SHAPED GRATE

(75) Inventors: Ming-Chuo Lee, No. 11-3, Lin 2, San-Shih Tsun, Ta-Yuan Hsiang, Tao-Yuan Hsien (TW); Johnson Huang, Taipei Hsien (TW)

(73) Assignee: Ming-Chuo Lee (TW)

( * ) Notice: Subject to any disclaimer, the term of this patent is extended or adjusted under 35 U.S.C. 154(b) by 0 days.

(21) Appl. No.: 10/463,241

(22) Filed: Jun. 17, 2003

(51) Int. Cl.[7] ..... F23G 5/00; F23G 5/44; F23G 7/00; F23M 9/04; F23J 1/00

(52) U.S. Cl. ..... 110/259; 110/322; 110/204; 110/235; 110/309; 110/165 R; 110/166; 110/315

(58) Field of Search ..... 110/204, 235, 110/295, 298, 302, 303, 309, 165 R, 166, 167, 314, 322, 259, 315, 346

(56) References Cited

U.S. PATENT DOCUMENTS 4,574,710 A * 3/1986 Pickard ..... 110/234
6,325,000 B1 * 12/2001 Furuta ..... 110/229

FOREIGN PATENT DOCUMENTS

| | | | | |
|---|---|---|---|---|
| JP | 6-50515 | * | 6/1994 | ..... F23G/5/00 |
| JP | 6-50516 | * | 6/1994 | ..... F23G/5/00 |
| JP | 6-50517 | * | 6/1994 | ..... F23G/5/00 |
| JP | 6-134434 | * | 6/1994 | ..... B09B/3/00 |

* cited by examiner

*Primary Examiner*—K. B. Rinehart
(74) *Attorney, Agent, or Firm*—Akin Gump Strauss Hauer & Feld, L.L.P.

(57) ABSTRACT

An incinerator includes a peripheral wall having a top end and formed with an inlet at the top end and an outlet below the inlet, a bowl-shaped grate disposed between the inlet and the outlet, a plurality of laterally extending baffles extending from a bottom end of the grate to the peripheral wall, and a plurality of vertically extending baffles disposed between the peripheral wall and the grate.

2 Claims, 5 Drawing Sheets

INCINERATOR WITH A BOWL-SHAPED GRATE

BACKGROUND OF THE INVENTION

1. Field of the Invention

This invention relates to an incinerator, more particularly to an incinerator with a bowl-shaped grate mounted in a combustion chamber.

2. Description of the Related Art

FIG. 1 illustrates a conventional incinerator that has a first combustion chamber 1, a second combustion chamber 2 disposed above the first combustion chamber 1, a water circulating device 3 disposed above the second combustion chamber 2, and a stack 4 connected to the second combustion chamber 2. A feed pump 101 is disposed adjacent to the first combustion chamber 1 for delivering combustible waste from a hopper 102 to a grate 106 in the first combustion chamber 1. A stirrer 103 is used to stir the combustible waste on the grate 106 so as to enhance combustion of the combustible waste. The resultant ash or slag is discharged from an outlet port 105.

Although the combustion can be enhanced with the provision of the stirrer 103, incomplete combustion of the combustible waste is still likely to happen for the aforesaid conventional incinerator.

SUMMARY OF THE INVENTION

Therefore, the object of the present invention is to provide an incinerator that is capable of overcoming the aforesaid drawback of the prior art.

According to the present invention, there is provided an incinerator that comprises: a peripheral wall that defines a combustion chamber therein, that has a vertically extending portion and a top end, and that is formed with an inlet adjacent to the top end and adapted to permit entry of air flow therethrough and into the combustion chamber, and an outlet disposed below the inlet and adapted to permit discharge of combustion gases therefrom; a bowl-shaped grate adapted to receive combustible waste therein and mounted in the combustion chamber at a level between the inlet and the outlet in such a manner to permit air flow from the inlet to pass downwardly through the combustible waste in the bowl-shaped grate toward the outlet, the bowl-shaped grate being spaced apart from and cooperating with the vertically extending portion of the peripheral wall to define a circulating space therebetween, and having a bottom end; a plurality of laterally extending baffles, each of which extends laterally from the bottom end of the bowl-shaped grate to the vertically extending portion of the peripheral wall; and a plurality of vertically extending baffles, each of which is disposed between the vertically extending portion of the peripheral wall and the bowl-shaped grate above the laterally extending baffles to divide the circulating space into a downward-flowing zone between the vertically extending baffles and the vertically extending portion of the peripheral wall and an upward-flowing zone between the vertically extending baffles and the bowl-shaped grate. Each of the vertically extending baffles is spaced apart from an adjacent one of the laterally extending baffles to define a gap therebetween so as to permit fluid communication between the downward-flowing and upward-flowing zones. An ash tray is mounted in the combustion chamber at a level between the bottom end of the bowl-shaped grate and the outlet.

BRIEF DESCRIPTION OF THE DRAWINGS

In drawings which illustrate an embodiment of the invention.

DETAILED DESCRIPTION OF THE PREFERRED EMBODIMENT

Figure 1:
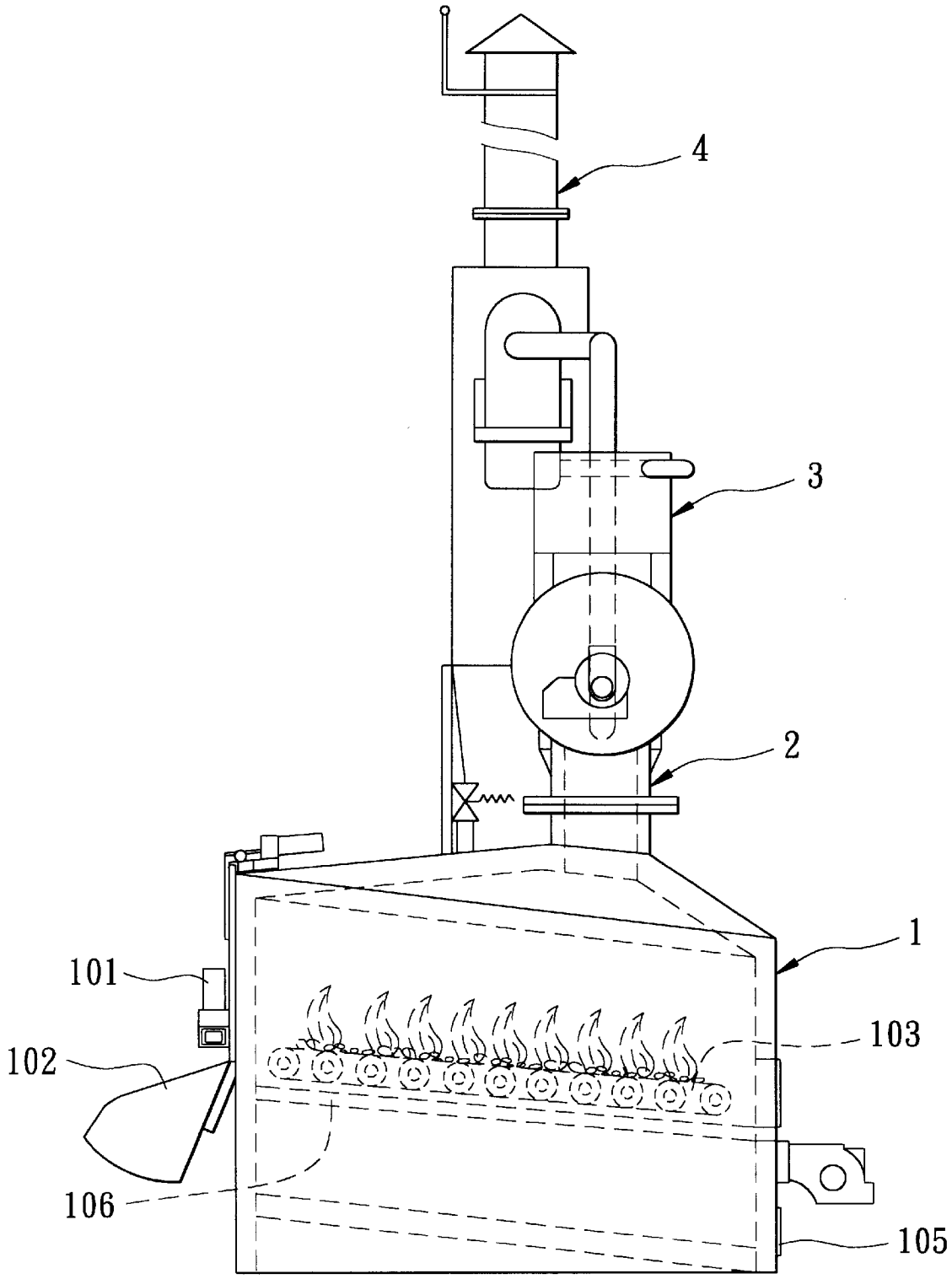
FIG. 1 PRIOR ART
FIG. 1 is a schematic view of a conventional incinerator.
Figure 2:
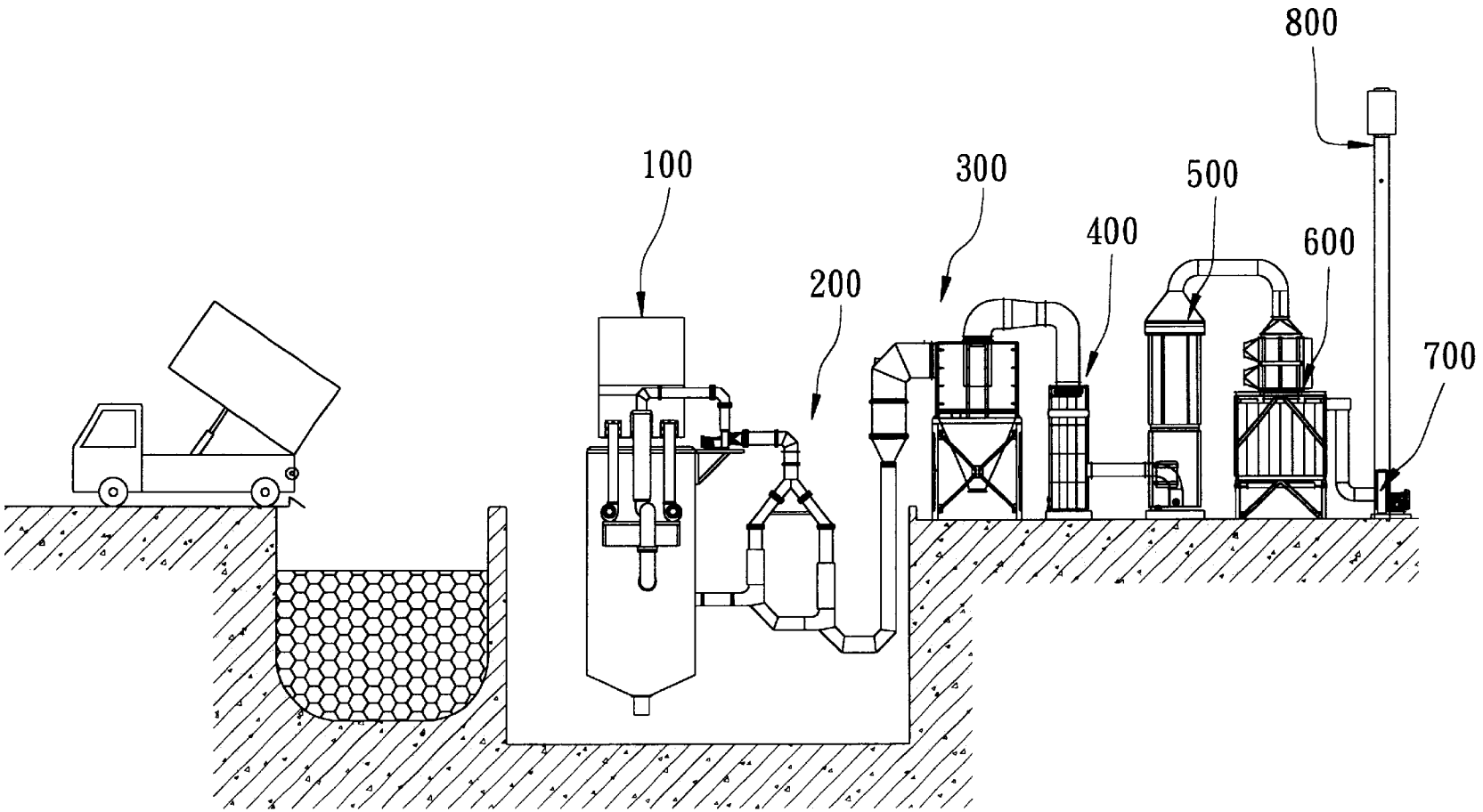
FIG. 2 is a schematic flow diagram illustrating how the preferred embodiment of an incinerator is connected to peripheral devices according to the present invention.

FIG. 2 is a flow diagram of an incineration system that includes an incinerator 100, a circulating unit 200 downstream of and connected to the incinerator 100, a cyclone separator 300 downstream of and connected to the circulating device 200, a Venturi-scrubbing unit 400 downstream of and connected to the cyclone separator 300, a wet-type electrostatic precipitator unit 500 downstream of and connected to the Venturi-scrubbing unit 400, an active carbon absorbing unit 600 downstream of and connected to the wet-type electrostatic precipitator unit 500, an induced fan 700 connected to the active carbon absorbing unit 600, and a stack 800 connected to the induced fan 700.

Figure 3:
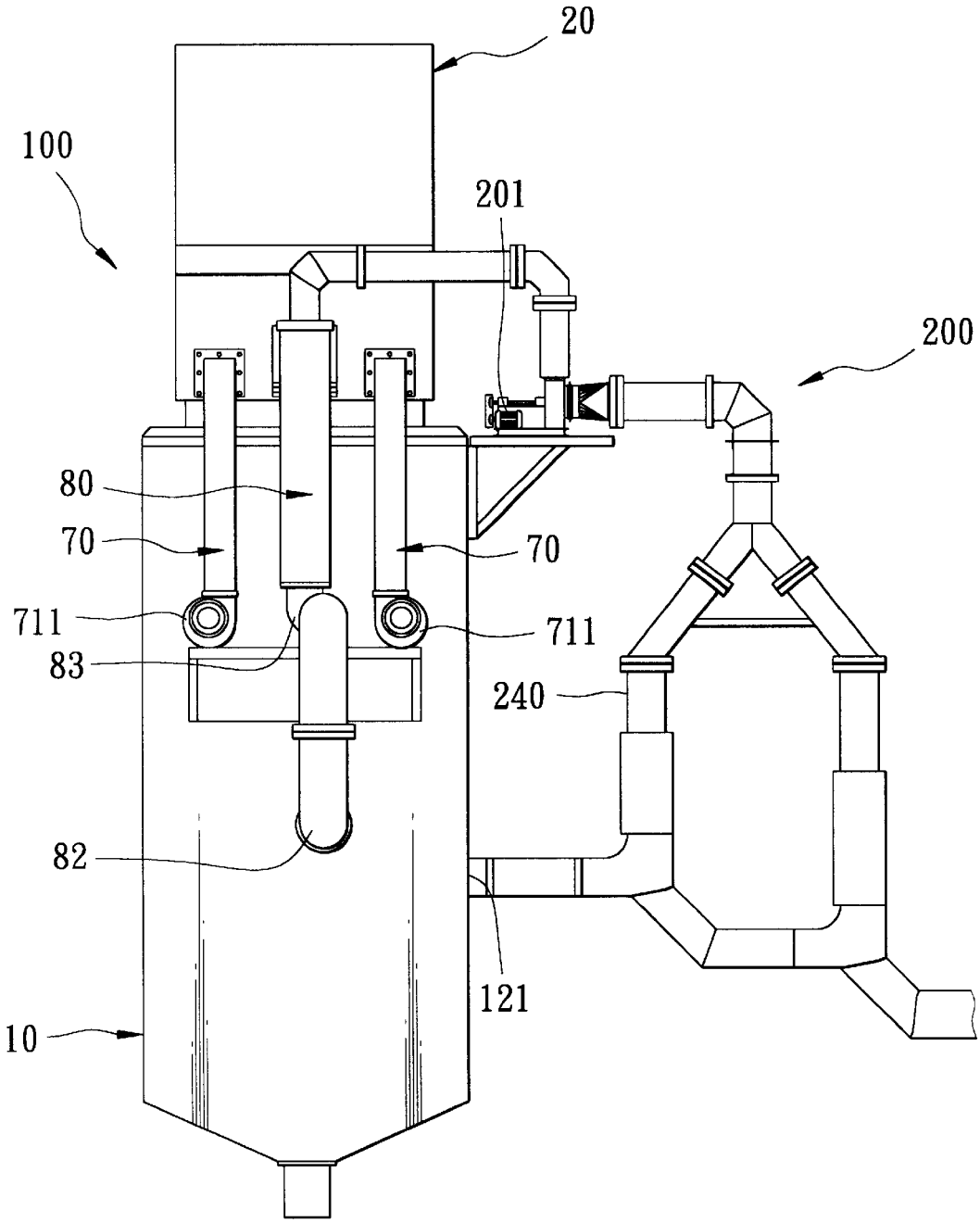
FIG. 3 is a schematic side view of the incinerator of FIG. 2.
Figure 4:
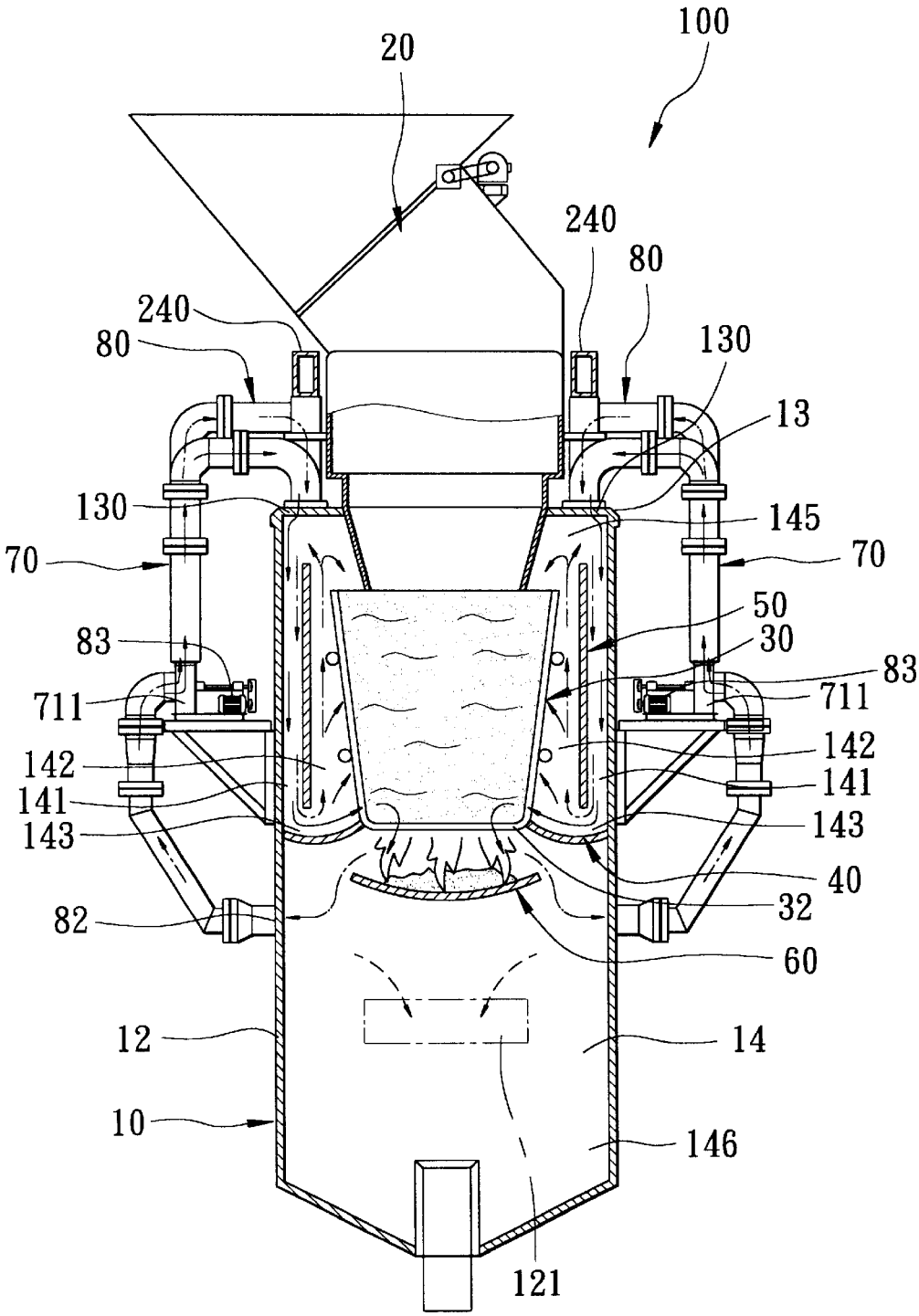
FIG. 4 is a schematic, partly sectional view of the incinerator of FIG. 2.
Figure 5:
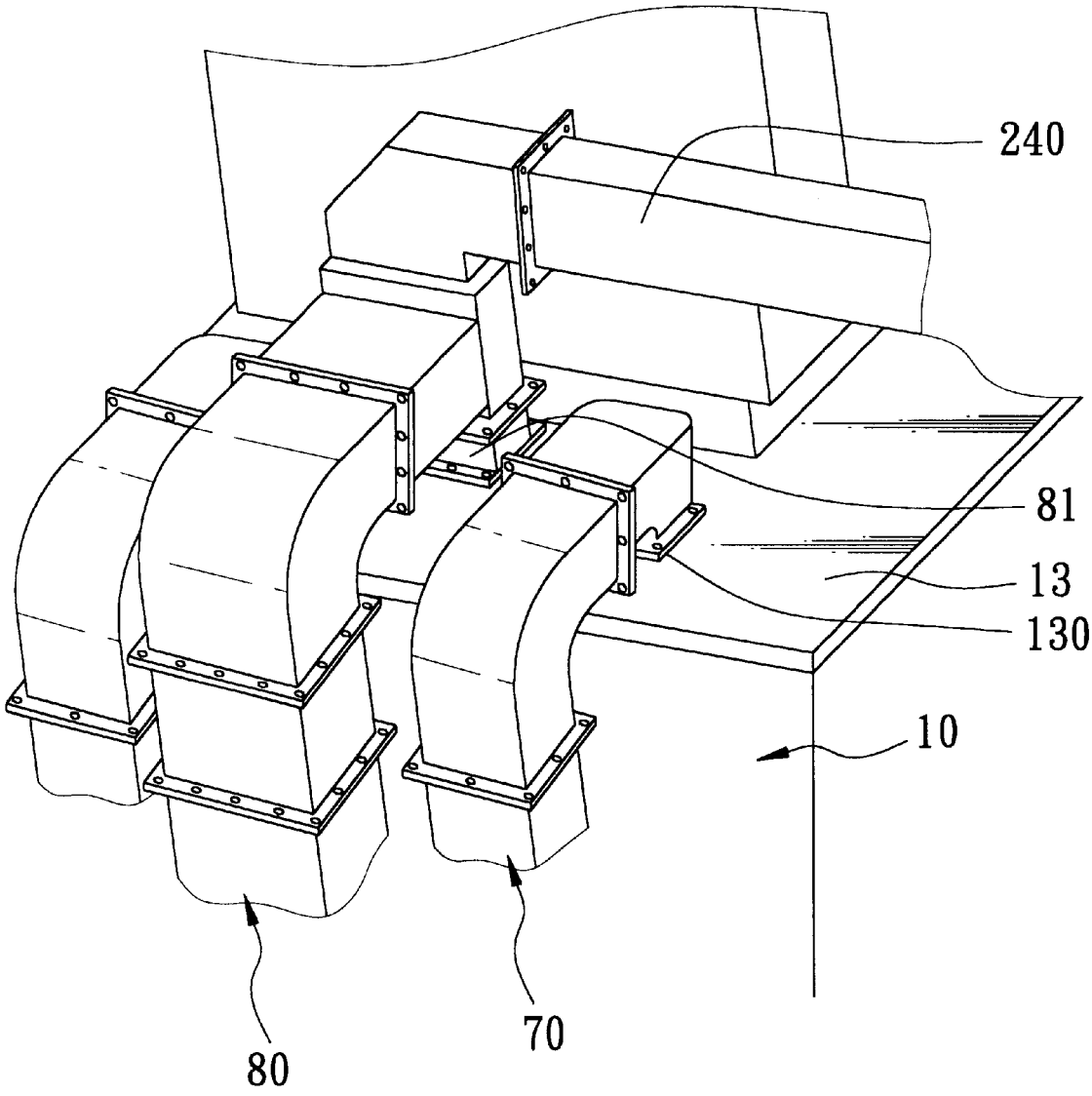
FIG. 5 is a schematic, fragmentary perspective view of the incinerator of FIG. 2.

Referring to FIGS. 3 to 5, the incinerator 100 includes: a peripheral wall 10 that defines a combustion chamber 14 therein, that has a vertically extending portion 12 and a top end 13, and that is formed with two air inlets 130 in the top end 13 (alternatively, the air inlets 130 can be formed at a position adjacent to the top end 13) and adapted to permit entry of air flow therethrough and into the combustion chamber 14, and an outlet 121 disposed below the air inlets 130 and adapted to permit discharge of combustion gases therefrom; two air blowers 711 respectively connected to the air inlets 130 through two pipelines 70; a bowl-shaped grate 30 adapted to receive combustible waste therein and mounted in the combustion chamber 14 at a level between the air inlets 130 and the outlet 121 in such a manner to permit air flow from the air inlets 130 to pass downwardly through the combustible waste in the bowl-shaped grate 30 toward the outlet 121, the bowl-shaped grate 30 being spaced apart from and cooperating with the vertically extending portion 12 of the peripheral wall 10 to define a circulating space therebetween, and having a bottom end 32; a plurality of laterally extending baffles 40, each of which extends laterally from the bottom end 32 of the bowl-shaped grate 30 to the vertically extending portion 12 of the peripheral wall 10; and a plurality of vertically extending baffles 50, each of which is disposed between the vertically extending portion 12 of the peripheral wall 10 and the bowl-shaped grate 30 above the laterally extending baffles 40 to divide the circulating space 14 into a downward-flowing zone 141 between the vertically extending baffles 50 and the vertically extending portion 12 of the peripheral wall 10 and an upward-flowing zone 142 between the vertically extending baffles 50 and the bowl-shaped grate 30. Each of the vertically extending baffles 50 is spaced apart from an adjacent one of the laterally extending baffles 40 to define a gap 143 therebetween so as to permit fluid communication between the downward-flowing and upward-flowing zones 141, 142 and so as to permit circulation of air flow, which is introduced into the combustion chamber 14 through the air inlets 130, between the downward-flowing and upward-flowing zones 141, 142. By virtue of the laterally extending baffles 40 and the vertically extending baffles 50, air flow from the inlets 130 can be directed toward the bowl-shaped grate 30 to result in effective combustion of the waste in the bowl-shaped grate 30.

A feed hopper 20 is mounted on the top end 13 of the peripheral wall 10 so as to deliver the combustible waste to the bowl-shape grate 30.

An ash tray 60 is mounted in the combustion chamber 14 at a level between the bottom end 32 of the bowl-shaped grate 30 and the outlet 121 for receiving ash and slag falling from the bowl-shaped grate 30. Since the outlet 121 is positioned at a level below the air inlets 130 and the combustible waste in the bowl-shaped grate 30, flames in the combustion chamber 14 are blown in a downward direction by the air flow. The ash tray 60 is preferably spaced apart from the bottom end 32 of the bowl-shape grate 30 by a distance to be within the reach of the downward flames so as to ensure that unburned or incompletely burned waste falling to the ash tray 60 can be completely burned.

The peripheral wall 12 is further formed with a circulating outlet port 82 that is disposed at a level between the ash tray 60 and the outlet 121, and a circulating inlet port 81 that is disposed at the top end 13 of the peripheral wall 12. The bottom end 32 of the bowl-shaped grate 30 cooperates with the laterally extending baffles 40 to divide the combustion chamber 14 into an upper chamber 145 that is disposed adjacent to and that is in fluid communication with the circulating inlet port 81, and a lower chamber 146 that is disposed adjacent to and that is in fluid communication with the circulating outlet port 82. A blower 83 is connected to the circulating inlet and outlet ports 81, 82 through pipeline 80 so as to permit circulation of a portion of combustion gases from the lower chamber 146 to the upper chamber 145 and so as to enhance efficiency of combustion.

The circulating unit 200 includes a circulating pipeline 240 that is connected to the outlet 121 and a top end of the pipeline 80, and a blower 201 connected to the pipeline 240 so as to enhance circulation of combustion gases between the upper and lower chambers 145, 146.

By virtue of the downward flames in the combustion chamber 14 in the incinerator of this invention, the unburned or incompletely burned waste falling to the ash tray 60 from the bowl-shaped grate 30 can be completely burned, thereby eliminating the drawback as encountered in the prior art.

With the invention thus explained, it is apparent that various modifications and variations can be made without departing from the spirit of the present invention.

We claim:

1. An incinerator comprising:

a peripheral wall that defines a combustion chamber therein, that has a vertically extending portion and a top end, and that is formed with an inlet adjacent to said top end and adapted to permit entry of air flow therethrough and into said combustion chamber, and an outlet disposed below said inlet and adapted to permit discharge of combustion gases therefrom;

a bowl-shaped grate adapted to receive combustible waste therein and mounted in said combustion chamber at a level between said inlet and said outlet in such a manner to permit air flow from said inlet to pass downwardly through the combustible waste in said bowl-shaped grate toward said outlet, said bowl-shaped grate being spaced apart from and cooperating with said vertically extending portion of said peripheral wall to define a circulating space therebetween, and having a bottom end;

a plurality of laterally extending baffles, each of which extends laterally from said bottom end of said bowl-shaped grate to said vertically extending portion of said peripheral wall;

a plurality of vertically extending baffles, each of which is disposed between said vertically extending portion of said peripheral wall and said bowl-shaped grate above said laterally extending baffles to divide said circulating space into a downward-flowing zone between said vertically extending baffles and said vertically extending portion of said peripheral wall and an upward-flowing zone between said vertically extending baffles and said bowl-shaped grate, each of said vertically extending baffles being spaced apart from an adjacent one of said laterally extending baffles to define a gap therebetween so as to permit fluid communication between said downward-flowing and upward-flowing zones; and an ash tray mounted in said combustion chamber at a level between said bottom end of said bowl-shaped grate and said outlet.

2. The incinerator of claim 1, wherein said peripheral wall is further formed with a circulating outlet port that is disposed at a level between said ash tray and said outlet, and a circulating inlet port that is disposed adjacent to said top end of said peripheral wall, said bottom end of said bowl-shaped grate cooperating with said laterally extending baffles to divide said combustion chamber into an upper chamber that is disposed adjacent to and that is in fluid communication with said circulating inlet port, and a lower chamber that is disposed adjacent to and that is in fluid communication with said circulating outlet port, said incinerator further comprising a blower that is connected to said circulating inlet and outlet ports so as to permit circulation of a portion of combustion gases from said lower chamber to said upper chamber.

* * * * *